US008184060B2

(12) United States Patent
Du et al.

(10) Patent No.: US 8,184,060 B2
(45) Date of Patent: May 22, 2012

(54) LOW PROFILE ANTENNA

(75) Inventors: Xin Du, Schaumburg, IL (US); Jesse Lin, Chicago, IL (US); Miroslav Parvanov, Naperville, IL (US)

(73) Assignee: PCTEL, Inc., Bloomingdale, IL (US)

( * ) Notice: Subject to any disclaimer, the term of this patent is extended or adjusted under 35 U.S.C. 154(b) by 712 days.

(21) Appl. No.: 12/246,961

(22) Filed: Oct. 7, 2008

(65) Prior Publication Data

US 2010/0085264 A1 Apr. 8, 2010

(51) Int. Cl.
*H01Q 13/00* (2006.01)

(52) U.S. Cl. ..... 343/773

(58) Field of Classification Search ..... 343/772, 343/773, 750, 774

See application file for complete search history.

(56) References Cited

U.S. PATENT DOCUMENTS

| | | | | |
|---|---|---|---|---|
| 3,967,276 | A | 6/1976 | Goubau | |
| 4,074,268 | A * | 2/1978 | Olson | 342/399 |
| 6,608,600 | B2 * | 8/2003 | Eriksson | 343/797 |
| 7,190,318 | B2 * | 3/2007 | Cohen | 343/773 |
| 2008/0204354 | A1 * | 8/2008 | Moser | 343/898 |

FOREIGN PATENT DOCUMENTS

| | | | |
|---|---|---|---|
| DE | 41 10 156 | A1 | 10/1991 |
| DE | 197 11 990 | A1 | 9/1998 |
| WO | WO 2007/048258 | A1 | 5/2007 |

OTHER PUBLICATIONS

Extended European Search Report corresponding to Application No. 09172236.3, dated Jan. 29, 2010.
Abstract of GB 2 245 429 A. English translation of abstract of DE4110156 (A1) not availabe. DE4110156 (A1) was also published as GB 2 245 429 A.
English translation of abstract of DE19711990 (A1).
Planar Bow-Tie Antenna embedded in Circular Aperture Within Conductive Frame, IEEE Antnnas and Wireless Propagation Letters, vol. 5, 2006; Shi-Wei Qu et al., 3 pages.
A Monopolar Patch Antenna With Very Wide Impedance Bandwidth; Iee Transaction s on Antennas and Propagation, vol. 53, No. 2, Feb. 2005 K.-L. Lau et al.; 7 pages.
Ultrawide-Band Square Planar Metal-Plate Monopole Antenna With a Trident-Shaped Feeding Strip; IEEE Transactions on Antennas and Propagation Vo. 53, No. 4, Apr. 2005; Kin-Lu Wong et al.; 7 pages.
Wide-Band Omindirectional Square Cylindrical metal-Plate Monopole Antenna; Kin-Lu Wong et al.; IEEE Transactions on Antennas and Propagation, vol. 53, No. 8 Aug. 2005; 4 pages.
Electrically Small Antennas; Chu-Wheeler McLean(Chapter 1); 2 pages.

* cited by examiner

*Primary Examiner* — Jacob Y Choi
*Assistant Examiner* — Kyana R McCain
(74) *Attorney, Agent, or Firm* — Husch Blackwell LLP

(57) ABSTRACT

A multi-band antenna is provided that operates in at least two non-harmonically related frequency bands. The antenna includes a ground plane, a cone-shaped relatively high frequency antenna element with a tip of the high frequency antenna disposed adjacent to but electrically isolated from the ground plane with a base of the cone-shaped antenna element extending away from the ground plane, and at least three relatively low frequency antenna elements electrically connected to and extending between the base of the cone-shaped antenna element and the ground plane.

16 Claims, 6 Drawing Sheets

F = 700mH
Az = 0 deg

F = 800mH
Az = 0 deg

F = 900mH
Az = 0 deg

F = 1GHz
Az = 0 deg

F = 2GHz
Az = 0 deg

F = 3GHz
Az = 0 deg

F = 4GHz
Az = 0 deg

F = 5GHz
Az = 0 deg

F = 6Ghz

Az = 0 deg

F = 700mH
El = 0 deg

F = 800mH
El = 0 deg

F = 900mH
El = 0 deg

F = 1GHz
El = 0 deg

F = 2GHz
El = 0 deg

F = 3GHz
El = 0 deg

F = 4GHz
El = 0 deg

F = 5GHz
El = 0 deg

F = 6Ghz
C = 0 deg

LOW PROFILE ANTENNA

FIELD OF THE INVENTION

The field of the invention relates to radio frequency antenna and more particularly to antenna that operate in a number of different non-harmonically related frequencies.

BACKGROUND OF THE INVENTION

Digital wireless systems, such as wireless local area networks, or cellular devices, such as cellular telephones may exist in a number of different frequency bands and may each use a unique communication protocol. For example, cellular and GSM telephones may operate in the 750-960 MHz frequency band, PCS and UMTS may operate in a 1700-2170 MHz frequency band, and WIFI may operate in the 2.4-5.8 GHz bands.

However, cellular, PCS, UMTS, and WIFI are often used with different types of devices, each with a different functionality and data processing capability. Because of the different functionality, it is often necessary for service providers to provide simultaneous infrastructure access under each of the different protocols.

One complicating factor with providing simultaneous access is that access under the different protocols often occurs in a number of different environments. While the environment could also be out-of-doors, the environment could also involve use within a restaurant, theater or other user space. Such environments do not allow for the use of bulky antenna or antenna structure that detracts from the architecture of the space.

Another complicating factor is that cellular, PCS, UMTS, and WIFI often use frequency bands that are not harmonically related. As such, an antenna designed for one frequency band may not work with other bands.

One prior art solution to the problem of multiple frequency bands has been to combine a monopole antenna with a choke and a patch antenna to create a multi-band antenna structure. The patch may be conventional or include one or more slots for high frequency operation.

While, the use of the monopole and patch antenna is effective in some cases, the monopole antenna often experiences a phase reversal at high frequencies resulting in an elevation pattern split of a radiated signal. In addition where the patch antenna structure exceeds ¼ wavelength in high band frequencies, the radiated field has significant azimuth pattern distortion. Accordingly, a need exist for better antenna that operate in multiple non-harmonically related frequency bands.

SUMMARY

A multi-band antenna is provided that operates in at least two non-harmonically related frequency bands. The antenna includes a ground plane, a cone-shaped relatively high frequency antenna element with a tip of the high frequency antenna disposed adjacent to but electrically isolated from the ground plane with a base of the cone-shaped antenna element extending away from the ground plane, and at least three relatively low frequency antenna elements electrically connected to and extending between the base of the cone-shaped antenna element and the ground plane.

In another embodiment, the multi-band antenna includes, a ground plane, a hollow cone-shaped antenna element with a frustum of the cone-shaped antenna element coupled to an antenna feed adjacent the ground plane and a base extending away from the ground plane and at least three relatively low frequency antenna elements extending from and electrically coupling a base end of the high frequency antenna element with the ground plane.

DETAILED DESCRIPTION OF AN ILLUSTRATED EMBODIMENT

Ultra-wide-band (UWB) antennas have become more important in recent times because of the continued expansion of the use of portable devices. While UWBs are important, they are often difficult to integrate into many living or work spaces because of the height of such devices. However, it is difficult to lower the profile due to a number of fundamental limitations described in a number of references. Typically, the height of a UWB is on the order of about ¼ wavelength of the lowest operating frequency.

U.S. Pat. No. 3,967,276 to Goubau describes a relatively compact UWB. Many references have regarded Goubau as a significant advance in providing an antenna with a greater than 2:1 bandwidth, a VWSR of <3:1 and a height of only 0.097λ.

The rapid expansion in the use of wireless devices has increased the need for UWB antenna that are more flexible in their environments of use. Because of the increased need for infrastructure access by a growing number of different devices, the bandwidth requirement of UWBs has significantly increased. As a compromise between overall profile and bandwidth, the overall diameter of UWB has steadily increased.

The increased size of the radiating elements has caused increased UWB pattern distortion for a number of different reasons. In some antenna, the increased size causes phase reversal resulting in an elevation pattern split similar to that seen in many prior art dipole antenna. In other antenna, an asymmetric bulky radiating structure is provided that typically exceeds ¼ wavelength in the high band, causing azimuth pattern distortion.

As a more specific example, Mars Antenna provides an antenna with a single PCB inside. The single PCB has the advantage of low cost, but with increased pattern distortion.

Another antenna provide by Mars Antenna provides two quarter-wave monopoles disposed adjacent each other with a height of about 0.16 wavelength. While this antenna is adequate in some applications, it lacks bandwidth.

In general, electrically small antennas (ESA) operate under a set of limitations referred to as the Chu-Wheeler-McLean limitations. For example, the expected bandwidth (or Q) versus profile of an ESA can be evaluated using the Chu-Wheeler-McLean limitations. For a single lowest transverse electrical (TE) or transverse magnetic (TM) mode, Q may be defined by the equation as follows, $$Q_1 = \frac{1}{ka} + \frac{1}{k^3a^3},$$

where a is the diameter of the antenna and $k=2\pi/\lambda$. Moreover in the case of the lowest TE and TM mode due to the TE and TM mode energy interchange, Q may be further defined by the equation as follows, $$Q_2 = \frac{1 + 3k^2a^2}{2(1 + k^2a^2)k^3a^3}.$$

Bandwidth (BW) under certain VSWR or return loss (typically 10 dB) may be defined as follows $$BW = \frac{VSWR - 1}{2Q\sqrt{VSWR}}.$$

Figure 1A:
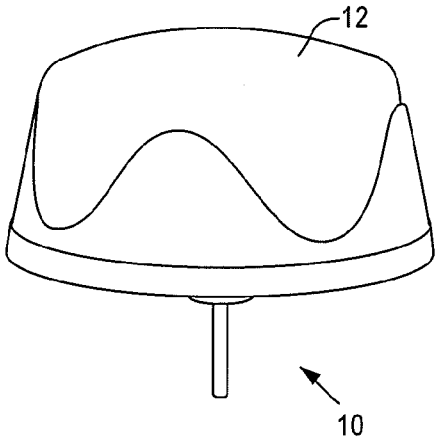
FIGS. 1*a-b* are perspective views of a low profile antenna with and without a protective cover shown generally in accordance with an illustrated embodiment of the invention.
Figure 1B:
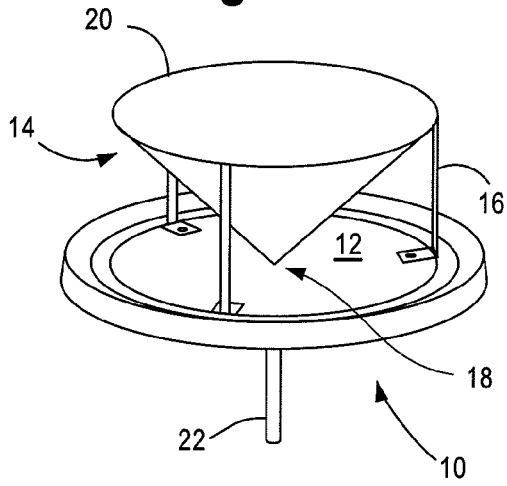
Figure 2A:
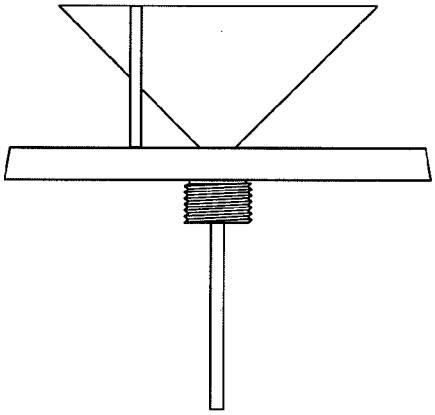
FIGS. 2*a-b* are side and side cut-away views of the antenna of FIG. 1.

Turning now to the figures, FIG. 1*a-b* depicts a low profile, wide-band antenna 10 shown generally in accordance with an illustrated embodiment of the invention. FIG. 1*a* shows the antenna 10 with a protective cover 12. FIG. 1*b* is a side perspective view of the antenna 10 without the cover 12. FIG. 2*a* is a side view of the antenna 10 and FIG. 2*b* is a cut-away view of the antenna 10 along lines A-A.

The antenna 10 includes a cone-shaped antenna element 14 disposed proximate the ground plane 12. As shown in FIG. 2*b*, a tip 18 the cone-shaped element 14 is disposed adjacent the ground plane 12 with a base 20 extending away from the ground plane 12 orthogonal to the ground plane 12.

Figure 2B:
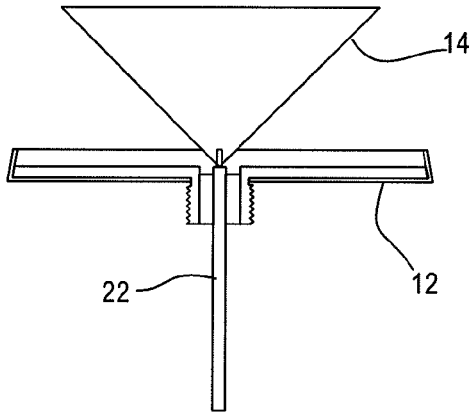

As shown in FIG. 2*b*, a proximate end of the cone-shaped element 14 is electrically isolated from the ground plane 12. The tip 18 is electrically connected to an RF supply cable 22.

While FIGS. 1 and 2 show the cable connected to the tip 18 of the cone-shaped element 14, it should be appreciated that the tip 18 may be truncated to allow a conductor of the cable 22 to penetrate the tip 18 of cone-shaped element 14 for a better connection. In this case, the connection with the cable 22 may be with a frustum of the cone-shaped element 14.

The cone-shaped antenna element 14 also includes a set of at least three secondary antenna elements 16. The secondary antenna elements 16 function to electrically connect a distal or base end of the cone-shaped antenna element 14 to the ground plane 12. The secondary antenna elements also function to mechanically support the cone-shaped element 14.

Figure 3:
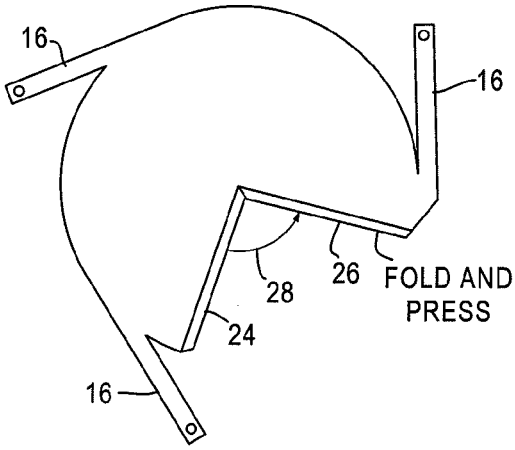
FIG. 3 is a partial fabrication view of the antenna of FIG. 1.

In general, the cone-shaped element 14 and secondary antenna elements 16 form a unitary antenna formed from a single flat sheet of conductive metal (e.g., copper). The flat piece of metal may be die cut as shown in FIG. 3. As shown in FIG. 3, a pie shaped portion may be removed by the die cutting process and opposing edges 24, 26 pulled together 28. The opposing edges 24, 26 may by joined by any appropriate method (e.g., welding, folding, etc.) to form a hollow cone.

Similarly, the secondary elements 16 may be folded downwards to form the supports 16 shown in FIGS. 1, 2 and 3. The distal ends of the secondary elements 16 (opposite the fold) may be electrically and mechanically joined to the ground plane 12 by another appropriate method (e.g., welding, riveting, etc.).

In effect, the cone-shaped element 14 may have a point contact on the proximal end with an antenna connection of the cable 22 adjacent the ground plane 12 and an annular cross-section parallel to the ground plane 12 with a diameter that diverges in a direction extending away from the ground plane. Opposing sides of the cone-shaped element 14 define a 45 degree angle.

In order to operate in the 700 Mhz to 8.5 GHz ranges, the cone shaped antenna element 14 may have a total height measured perpendicular to the ground plane of 1.97 inches. The diameter of the base of the cone-shaped antenna element 14 is approximately 3.95 inches.

The legs to ground (secondary elements 16) provide a number of different functionalities. At a lower range of the operating frequency range, the secondary elements 16 may function as radiating elements. In the middle range, the secondary elements 16 operate in a parallel resonant mode.

The symmetric arrangement of the secondary elements 16 cancel the horizontal moments and maintain the conical pattern of the antenna 10. The number of grounding legs (secondary antenna elements 16) affect the antenna profile as well as the radiation pattern. A symmetric arrangement is preferred for a more uniform azimuth pattern. Three secondary antenna elements 16 are shown in FIGS. 1 and 2 for a minimum profile while keeping the rotational symmetry.

Figure 4:
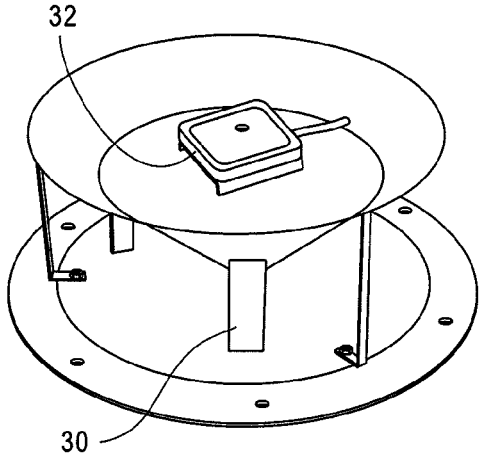
FIG. 4 is a side perspective view of the antenna of FIG. 1 under an alternate embodiment.

A set of parasitic elements 30 (FIG. 4) may be added to reduce the ripple in the upper frequency ranges. In this case, the parasitic elements 30 are electrically isolated from the ground plane 12.

Figure 5:
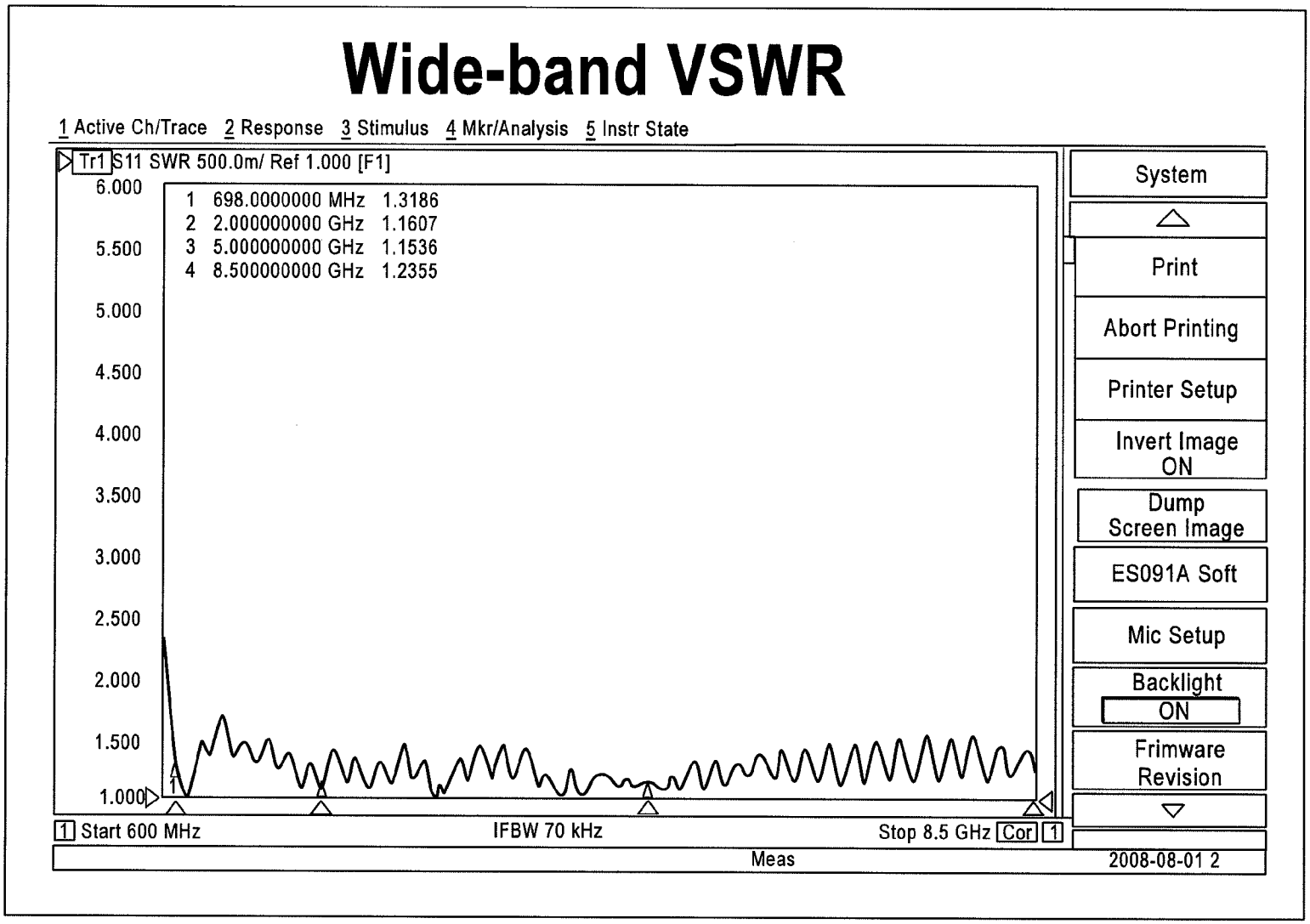
FIG. 5 is a VSWR chart of the antenna of FIG. 1 from 698 MHz to 8.5 GHz.
Figures 6A, 6B, 6C, 6D, 6E, 6F, 6G, 6H:
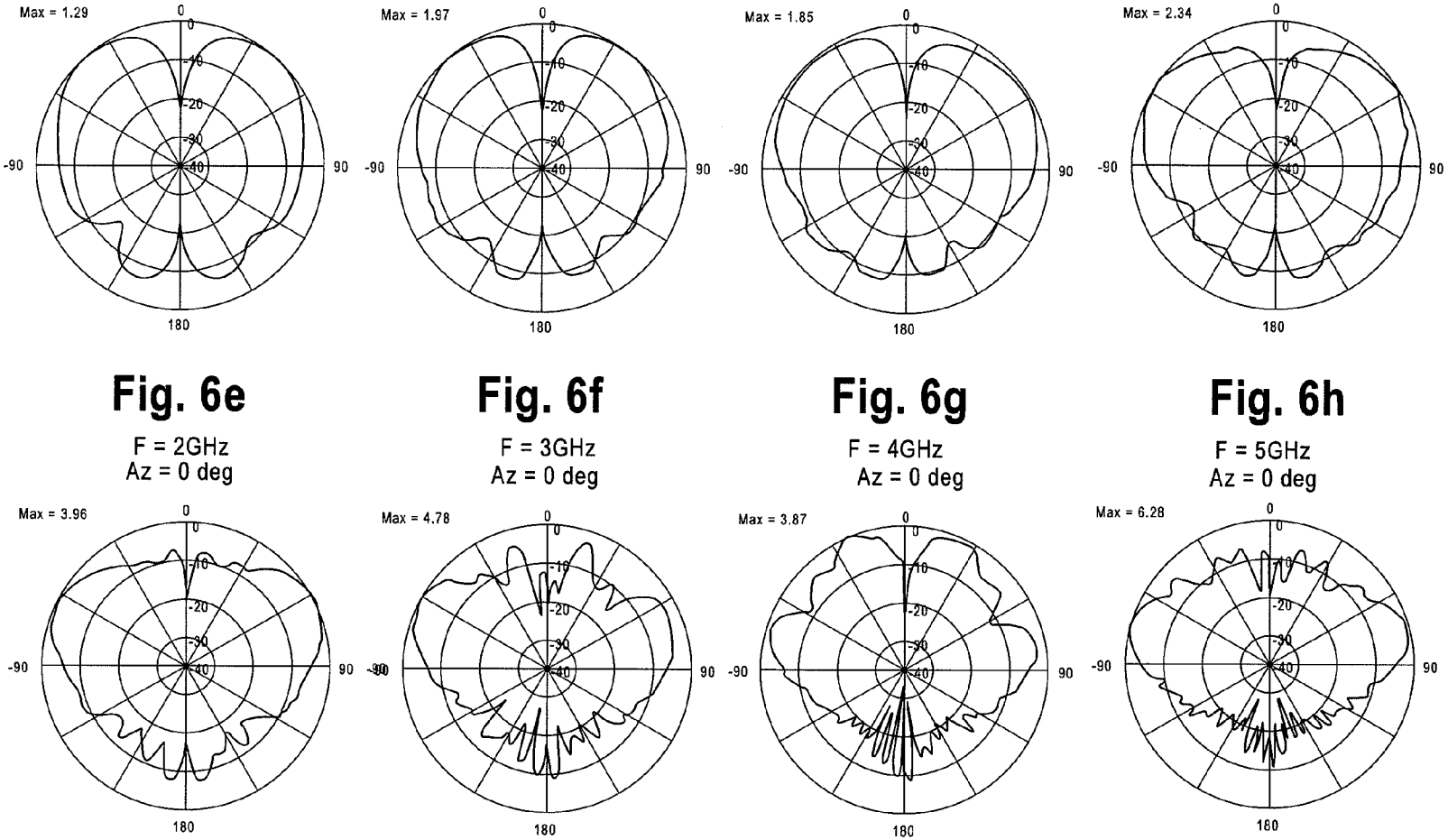
FIG. 6*a-i* are far field radiation patterns of the antenna of FIG. 1 from 700 MHz to 6 GHz.
Figure 6I:
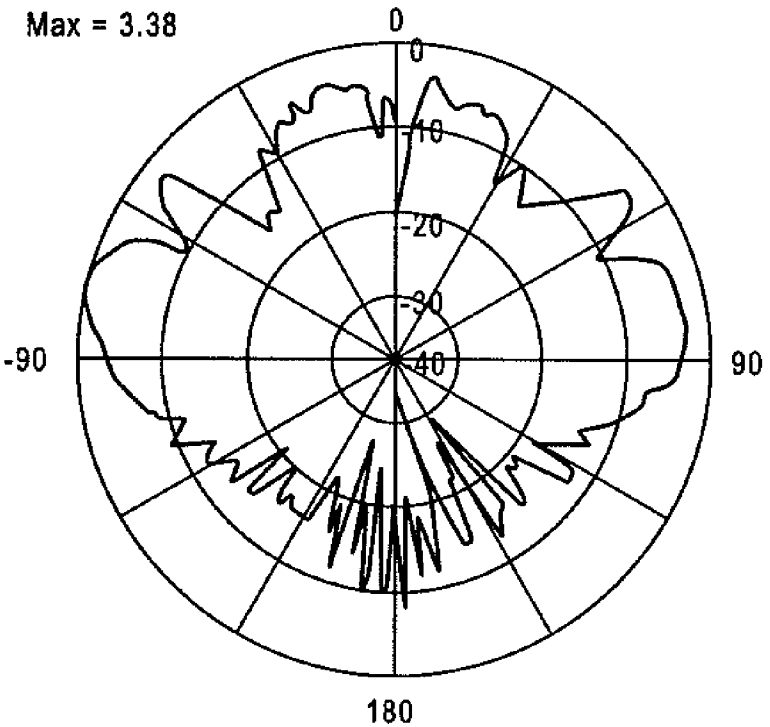
Figure 7A:
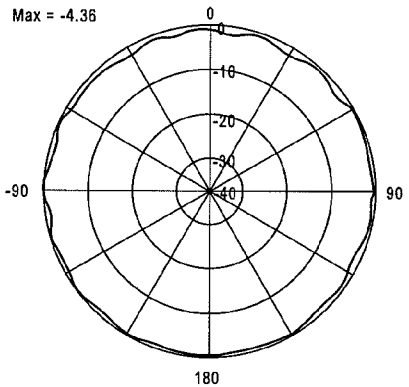
FIG. 7*a-i* are far field radiation patterns of the antenna of FIG. 1 from 700 MHz to 6.0 GHz.
Figure 7B:
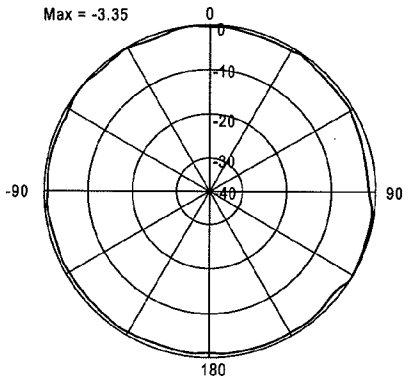
Figure 7C:
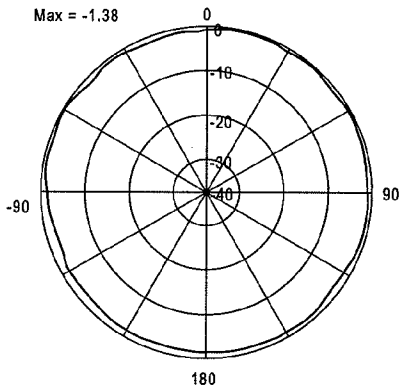
Figure 7D:
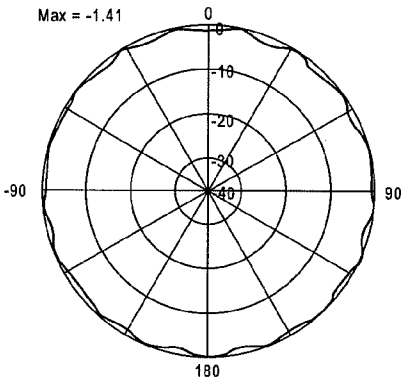
Figure 7E:
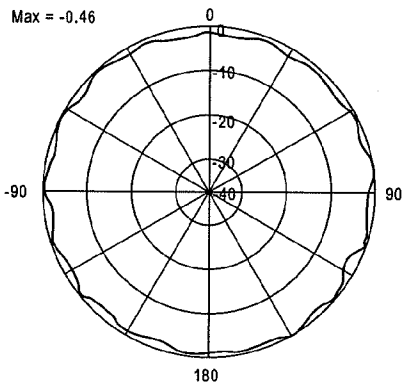
Figure 7F:
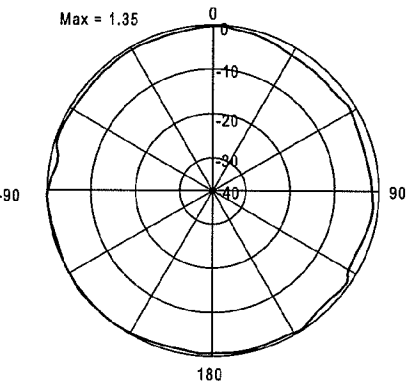
Figure 7G:
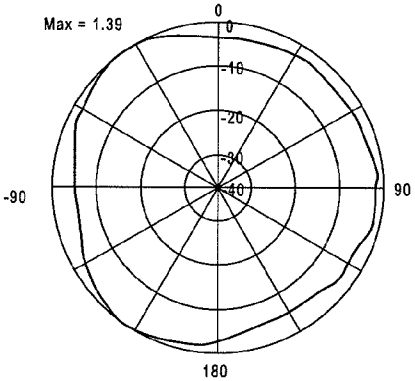
Figure 7H:
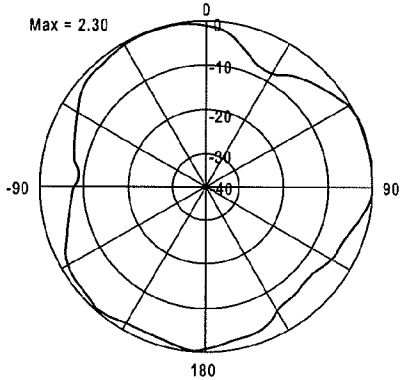
Figure 7I:
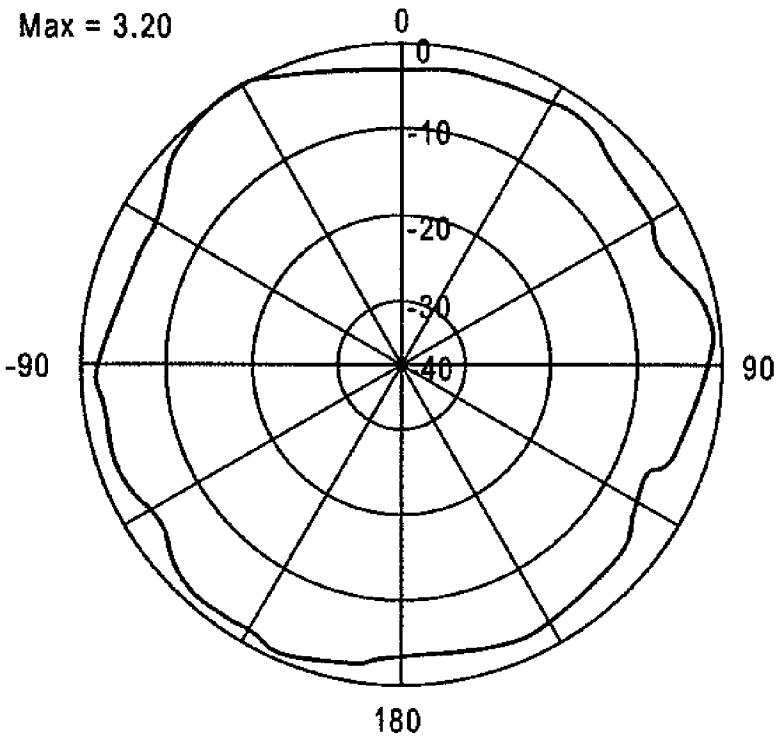

FIG. 5 is a VSWR chart for the antenna 10 in the frequency range between 698 MHz and 8.5 GHz. As may be noted, the antenna 10 has a VSWR of less than 1.7 over the entire frequency range of from 698 MHz to 8.5 GHz.

The antenna 10 provides a lower relative profile than conventional antenna with a height at the low frequency limit of 698 MHz of no more than one-eight wavelength. The impedance of the antenna 10 remains substantially above a lower limit of −10 dB over the entire bandwidth of 698 MHz to 8.5 GHz.

The Chu-Wheeler-McLean equations (discussed above) may be used to calculate a predicted bandwidth (BW) of the claimed antenna using a diameter of 3.95 inches and a frequency of 698 MHz. The Chu-Wheeler-McLean equations suggests that the claimed antenna should have a bandwidth of no greater than 5.25:1. Instead the claimed antenna has been demonstrated to have a bandwidth of 12:1.

FIGS. 6*a-i* are elevation views of far field radiation patterns from 700 MHz to 6.0 GHz. As can be seen, the azimuth far field patterns at 698 MHz are substantially symmetric as would be expected from the symmetry along an antenna axis orthogonal to the ground plane.

FIGS. 7*a-i* are elevation views of far field radiation patterns from 700 MHz to 6.0 GHz. As can be seen, the azimuth far field patterns at 6.0 GHz are substantially symmetric as would also be expected from the symmetry orthogonal to the ground plane.

In another illustrated embodiment, base 20 of the antenna 10 may be used to support a patch antenna 32. In this case, the antenna 32 is a global positioning system (GPS) active antenna module. A cable (not shown) for the antenna 32 may extend from the ground plane 12 to the base 20 and antenna 32 along one of the secondary antenna elements 16 so that there is no interference to the radiation pattern.

A specific embodiment of a low profile antenna has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A low profile, wide-band antenna operating in a frequency range between approximately 700 MHz and approximately 8.5 GHz, such antenna comprising:

a ground plane;

a cone-shaped relatively high frequency antenna element with a tip of the high frequency antenna element disposed adjacent to but electrically isolated from the ground plane with a base of the cone-shaped antenna element extending away from the ground plane; and three relatively low frequency antenna elements symmetrically arranged around the cone-shaped antenna element and electrically connecting and extending between the base of the cone-shaped antenna element and the ground plane, wherein a total height of the low profile, wide-band antenna is approximately equal to one-eighth wavelength (approximately 0.12λ) at a low frequency limit, wherein a diameter of the base of the cone-shaped antenna element is approximately equal to 0.232λ at the low frequency limit, and wherein a bandwidth of the low profile, wide-band antenna is approximately 12:1 with a voltage standing wave ratio (VSWR) of less than approximately 1.8 over the entire frequency range.

2. The low profile, wide-band antenna of claim 1 wherein the high frequency antenna and low frequency antenna elements further comprise a unitary sheet of conductive material.

3. The low profile, wide-band antenna of claim 1 wherein opposing sides of the cone shaped antenna element extending from the tip further comprise substantially a forty-five degree angle.

4. The low profile, wide-band antenna of claim 1 wherein the three low frequency antenna elements further comprise a 120 degree spacing around a periphery of the base.

5. The low profile, wide-band antenna of claim 1 further comprising a patch antenna supported by the base of the cone-shaped antenna element.

6. The low profile, wide-band antenna of claim 1 wherein the tip of the cone-shaped antenna element further comprises a coaxial cable connection.

7. The low profile, wide-band antenna as in claim 1, wherein the three low frequency antenna elements function as radiating elements at a low end of the frequency range, and wherein the three low frequency antenna elements operate in a parallel resonant mode in a middle range of the frequency range.

8. The low profile, wide-band antenna as in claim 1, wherein the symmetric arrangement of the three low frequency antenna elements maintains a uniform azimuth pattern and a conical radiation pattern of the low profile, wide-band antenna, and wherein the three low frequency antenna elements minimize the total height of the low profile, wide-band antenna.

9. A low profile, wide-band antenna operating in a frequency range between approximately 700 MHz and approximately 8.5 GHz, such antenna comprising:

a ground plane;

a relatively high frequency antenna element electrically isolated from the ground plane on a proximal end, said high frequency antenna element having a point contact on the proximal end with an antenna connection adjacent the ground plane and an annular cross-section parallel to the ground plane with a diameter that diverges in a direction extending away from the ground plane; and three relatively low frequency antenna elements extending from and electrically coupling a distal end of the high frequency antenna element with the ground plane, the three low frequency antenna elements symmetrically arranged around the high frequency antenna element, each of said low frequency antenna elements occupying a distance of approximately one percent along the annulus of the distal end of the high frequency element, wherein a total height of the low profile, wide-band antenna is approximately equal to one-eighth wavelength (approximately 0.12λ) at a low frequency limit, wherein a diameter of a base of the high frequency antenna element is approximately equal to 0.232λ at the low frequency limit, and wherein a bandwidth of the low profile, wide-band antenna is approximately 12:1 with a voltage standing wave ratio (VSWR) of less than approximately 1.8 over the entire frequency range.

10. The low profile, wide-band antenna as in claim 6 wherein the divergence further comprises forty-five degrees.

11. A low profile, wide-band antenna operating in a frequency range between approximately 700 MHz and approximately 8.5 GHz, such antenna comprising:

a ground plane;

a hollow cone-shaped antenna element with a frustum of the cone-shaped antenna element coupled to an antenna feed adjacent the ground plane and a base extending away from the ground plane; and three relatively low frequency antenna elements extending from and electrically coupling a base end of the cone-shaped antenna element with the ground plane wherein the cone-shaped antenna element and low frequency antenna elements are fabricated from a single unitary sheet of conductive material, the three low frequency antenna elements symmetrically arranged around the cone-shaped antenna element, wherein a total height of the low profile, wide-band antenna is approximately equal to one-eighth wavelength (approximately 0.12λ) at a low frequency limit, wherein a diameter of the base of the cone-shaped antenna element is approximately equal to 0.232λ at the low frequency limit, and wherein a bandwidth of the low profile, wide-band antenna is approximately 12:1 with a voltage standing wave ratio (VSWR) of less than approximately 1:8 over the entire frequency range.

12. The low profile, wide-band antenna as in claim 11 wherein the diameter of the base is approximately 3.95 inches.

13. The low profile, wide-band antenna as in claim 11 wherein the total height is approximately 1.97 inches.

14. The low profile, wide-band antenna as in claim 11 wherein the low frequency antenna element further comprises a width tangent to the base substantially equal to 0.09 inches.

15. The low profile, wide-band antenna as in claim 11 wherein opposing walls of the cone-shaped antenna element further comprises a divergence of 45 degrees.

16. The low profile, wide-band antenna as in claim 11 wherein the frustum further comprises a radio frequency connection.

* * * * *